United States Patent [19]

Banoun

[11] Patent Number: 4,901,464

[45] Date of Patent: Feb. 20, 1990

[54] GUN DISASSEMBLY AND CLEANING KIT

[75] Inventor: Ike Banoun, Brentwood, Calif.

[73] Assignee: Alsa Corporation, Brentwood, Calif.

[21] Appl. No.: 186,393

[22] Filed: Apr. 26, 1988

[51] Int. Cl.[4] ..... F41C 31/00

[52] U.S. Cl. ..... 42/95; 206/579; 206/373; 206/362; 206/315.11

[58] Field of Search ..... 42/95; 206/579, 223, 206/373, 362, 315.11

[56] References Cited

U.S. PATENT DOCUMENTS

| | | | |
|---|---|---|---|
| 1,094,009 | 4/1914 | Parkhurst | 206/373 |
| 4,716,673 | 1/1988 | Williams et al. | 42/95 |

FOREIGN PATENT DOCUMENTS

| | | | |
|---|---|---|---|
| 923732 | 7/1947 | France | 206/373 |
| 19815 | of 1906 | United Kingdom | 206/373 |

OTHER PUBLICATIONS

Shooter's Bible, No. 54, 1963, p. 435, "Pak-Kit" (catalogue).

*Primary Examiner*—Charles T. Jordan
*Assistant Examiner*—Michael J. Carone
*Attorney, Agent, or Firm*—Bryan, Cave, McPheeters & McRoberts

[57] ABSTRACT

A portable gun disassembly and cleaning kit that can be used in the field is disclosed. The implements in the kit can be used to disassemble and clean essentially any type or size of gun (e.g., pistols, rifles, shotguns). The carrying case is flexible, foldable, water-resistant, and oil-resistant, and has spaces for securely holding all of the implements. A strap is pulled tight to secure the implements in their respective spaces inside the case.

10 Claims, 2 Drawing Sheets

GUN DISASSEMBLY AND CLEANING KIT

BACKGROUND OF THE INVENTION

The present invention relates to the field of guns and, more particularly, to the field of gun disassembly and cleaning.

Kits for cleaning specific types and sizes of guns have been known for many years; however, each such kit almost always contains implements for cleaning only one specific type and size gun. Thus, someone owning a variety of guns must purchase a different kit for each gun and must provide storage for all of those different kits. One kit containing implements for cleaning three different size guns is known but that kit comprises a solid wood case and is expensive, costing approximately $200. Other disadvantages of that kit include its unsuitability for use in the field and its lack of true portability in the field (it is too large for a pocket). It also cannot be used in cleaning substantially all types and sizes of guns.

Thus, there has been a long-standing need for a kit that contains implements for cleaning substantially all types and sizes of guns, yet is relatively inexpensive, requires a minimal amount of storage space, is truly portable, and can be used in the field.

SUMMARY OF THE INVENTION

The present invention fulfills that long-standing need and provides other benefits. Broadly, the gun disassembly and cleaning kit of the present invention comprises:

(a) implements for disassembling and cleaning essentially all types and sizes of guns, the implements being held securely in their storage spaces in the carrying case of element (b); and (b) a flexible, foldable, oil-resistant and water-resistant carrying case, said case being capable of being rolled up in jelly roll-fashion into its closed configuration and unrolled into a substantially flat open configuration; the case having two oppositely disposed longer edges, two oppositely disposed first and second shorter edges, an inner surface, and an outer surface that is outwardly disposed when the case is closed; rolling to close the case starting with the first shorter edge so that when the case is in its closed configuration the second shorter edge is exposed; the inner surface carrying gateways means that are attached to it and are spaced from one another on the inner surface, each such means having a portion that is not attached to the inner surface of the case so as to define a gateway, the gateways lying substantially in a line roughly parallel to the direction in which the case is rolled to close it; an elongate strap passing through the gateways and having two ends, the strap being fixed to the case near one end and extending beyond the second shorter edge of the case; two adjacent gateways means, the inner surface of the case therebetween, and the portion of the strap therebetween defining a storage space for one or more of the implements; all of the gateways being large enough in comparison to the cross-section of the strap so that the strap can be easily pulled through all of the gateways to securely hold all of the implements in their storage spaces when the case is rolled close to it and also after it has been closed.

The kit of this invention contains implements for cleaning substantially all types and sizes of guns, rolls up jelly roll-fashion into a relatively small volume that can be easily carried in the pocket of, for example, a hunter's coat, and is significantly less costly as compared to buying a number of individual cleaning kits as is typically done. Because the strap can easily be pulled tight, the implements can be secured in their respective storage spaces with a minimum of effort. The case of this kit is both oil-resistant and water-resistant, so it can be used in the field. Furthermore, when the kit is unrolled into its open position, it can lie flat on the ground and provide a clean work surface for the gun disassembly and cleaning procedure. Other features and advantages of the invention will be apparent to those skilled in the art.

BRIEF DESCRIPTION OF THE DRAWINGS

To facilitate further discussion of this invention, the following drawings are provided in which.

These drawings are for illustrative purposes only and should not be construed to limit the scope of the invention.

DETAILED DESCRIPTION OF THE INVENTION

Figure 1:
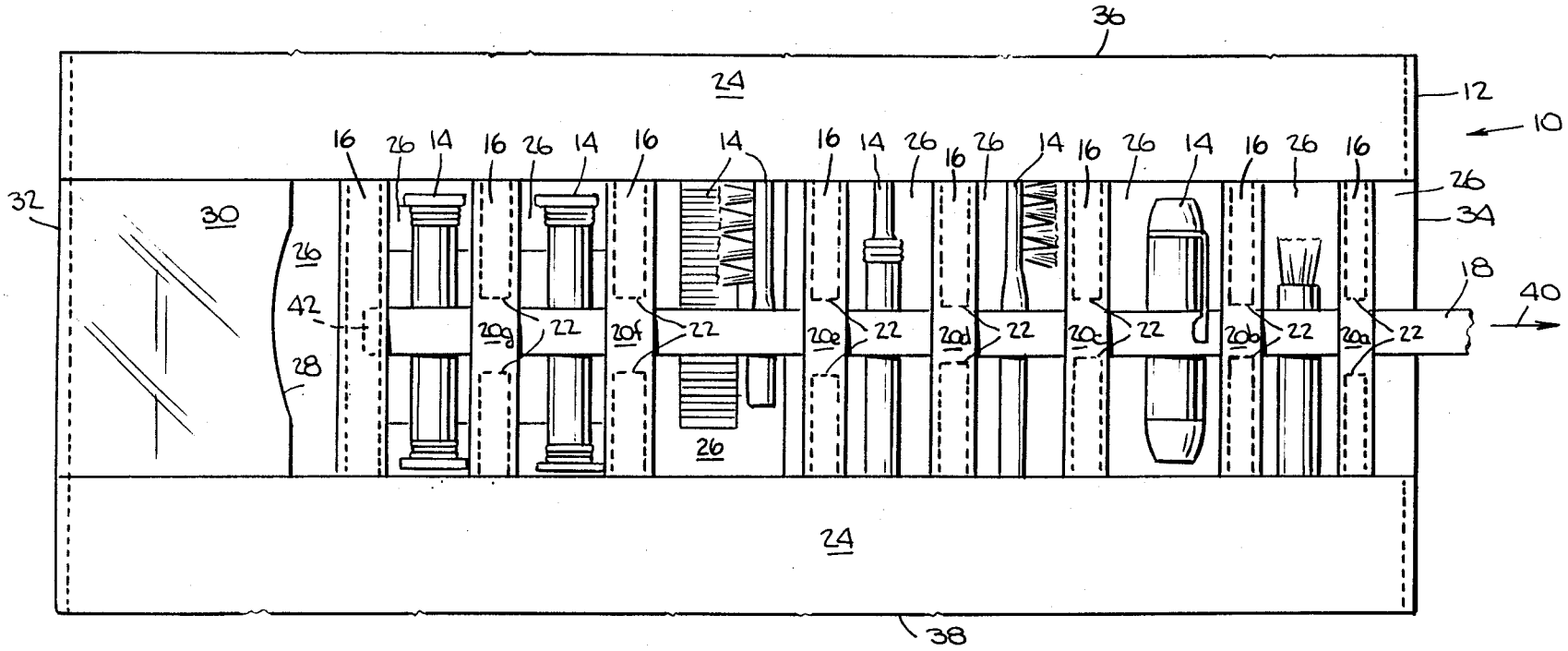
Fig. 1. PRIOR ART
FIG. 1 is a plan view of a prior art travel case holding personal grooming articles and the like in its open (unrolled) configuration.

FIG. 1 shows a prior art travel kit 10 comprising case 12 and implements 14 (toothbrushes, toothpaste, razor, comb, flashlight, and two screw-top vials). Inner surface 26 of case 12 had eight ribs 16. Strap 18 passed through all of the gateways 20 in the ribs, which were located in a line, and was fixed to the case at inner end 42. The gateways were bounded by inner surface 26, stitching 22, and the central portions of ribs 16. In this prior art case, some of the gateways were substantially wider than strap 18 (for example, gateway **20*a*) but at least one gateway was barely wider than the strap (gateway 20*d*). Because of the tight fit of strap 18 in gateway 20*d*, the strap was most difficult to pull in the direction shown by arrow 40. That made tightening the straps around the implements to the left of gateway 20*d*** to secure those implements in their storage spaces extremely difficult.

Case 12 had longer edges 36 and 38 and shorter edges 32 and 34. Side flaps 24 were disposed along and foldably attached to longer edges 36 and 38. Those flaps when folded down (as shown in FIG. 1) prevented any of the implements 14 from sliding out of the case sideways. Plastic sheet 30 was attached on three sides to inner surface 26 of the case to form pocket 28. The case was closed by rolling it up jelly roll-fashion, starting with short edge 32 and rolling towards short edge 34. The case was held closed by wrapping strap 18 around it. Strap 18 had VELCRO fastening strips so that strap 18 would "lock" on itself to prevent the rolled-up kit from unrolling.

In this prior art case, the corners where short edge 34 met long edges 36 and 38 were not rounded, inner surface 26 was of fabric and was not oil- and water-resistant, and, as noted above, strap 18 was most difficult to pull tight around all of the implements in the storage spaces between ribs 16.

Figure 2:
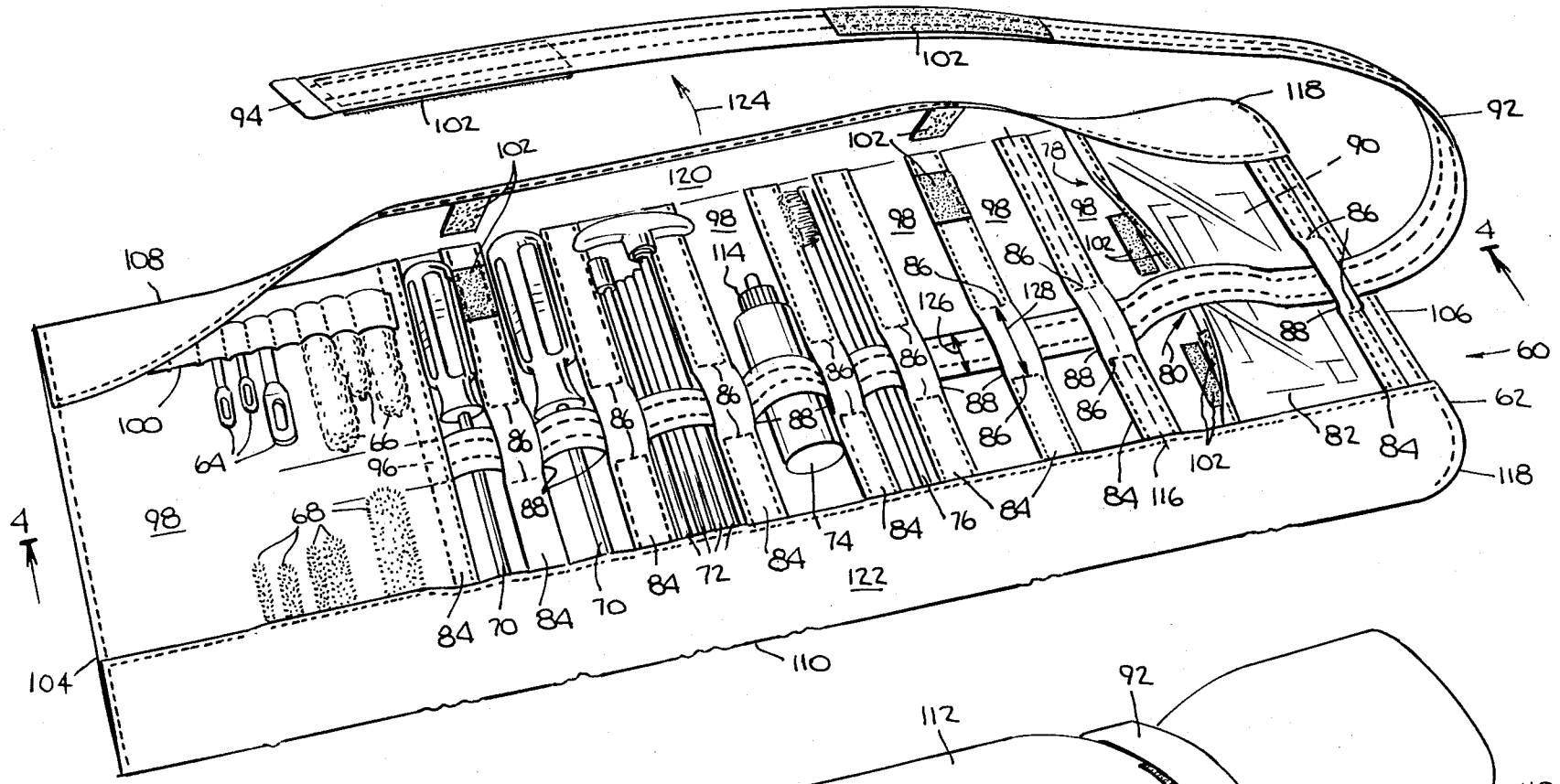
FIG. 2 shows the gun cleaning kit of the present invention in its open (unrolled) configuration.

FIG. 2 shows kit 60 of the present invention comprising case 62 and assorted implements for gun disassembly and cleaning. Those implements include patch holders 64, swabs 66, bore brushes 68, screwdrivers 70, rod assembly (with extensions) 72, solvent/lubricant container 74, utility brush 76, and patches 90 inside pocket 78. Pocket 78 is formed by plastic sheet 82, which is attached on three sides to inner surface 98. Two pairs of VELCRO fastening pads 102 are located at the opening of pocket 78 to releasably hold the pocket opening closed. Arrow 80 indicates the direction in which the end of plastic sheet 82 is pulled to open the pocket.

Nine ribs 84 are located along inner surface 98. All of the ribs except the extreme leftmost rib have stitching 86 defining gateways 88 through which strap 92 passes. Strap 92 is fixed at one end 96 to case 12. Two VELCRO fastening strips 102 are located near free end 94 of strap 92. Elastic strap 100 is sewn to the inner surface of the case to provide storage slots for small implements 64 and 66. A similar elastic strap (not shown) is used to hold small implements 68 in place.

All of gateways 88 are sufficiently wider than strap 92 so that pulling strap 92 to tighten it is significantly easier than pulling prior art strap 18 (FIG. 1) to tighten it. This is important because the sizes of the gun disassembly and cleaning elements varies so greatly. For example, the shaft of screwdriver 70 is significantly smaller than the diameter of container 74 (see FIG. 4). For a preferred strap, which is about 1.5 millimeters thick and about 25 millimeters wide (reference numeral 126), the width of each gateway (reference numeral 128) should be at least about 38 millimeters so that the strap can be pulled tight without excessive force.

Each storage space is defined by two adjacent ribs, the portion of the inner surface therebetween, and the portion of the strap therebetween. For example, storage space 114 for container 74 is defined by the two adjacent ribs 84, the portion of inner surface 98 between those ribs, and that portion of strap 92 between those ribs. When strap 92 is pulled tight, the implements are held fast in their storage spaces, thereby preventing them from falling out of the case. Drawing the strap tight to hold the implements in place desirably occurs after the case has been rolled up and before the strap is locked on itself by means of the VELCRO fasteners on the strap. Flaps 120 and 122 are foldably connected to longer edges 108 and 110 of the case. Flap 120 is opened by pulled it in the direction shown by arrow 124. It is normally held in a down position by VELCRO fastening pads 102. Flap 122 is held closed and opened in the same way as is flap 120.

Figure 3:
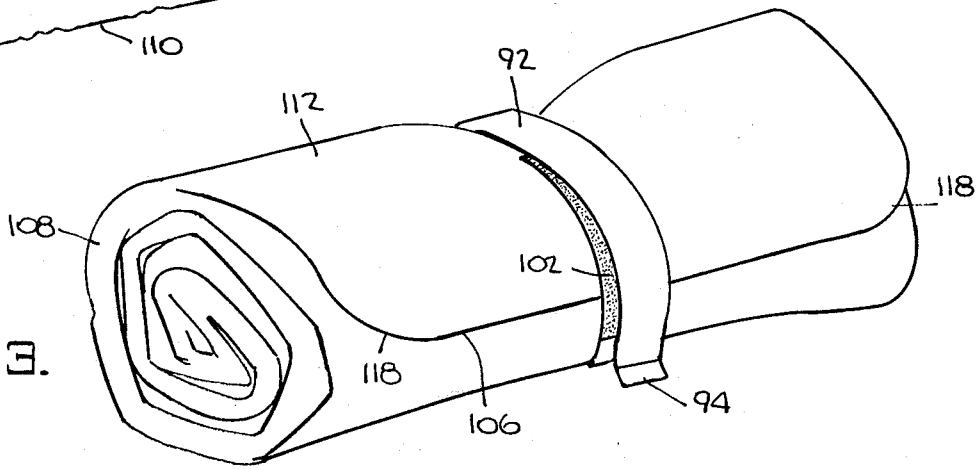
FIG. 3 shows the kit of this invention in its closed (rolled-up) configuration.

Case 62 has first shorter edge 104, second shorter edge 106, and longer edges 108 and 110. To close the case, strap 92 is pulled tight to secure the implements in place and the first and second side flaps 120 and 122 are pushed down to insure that VELCRO fastening strips 102 lock the flaps in place. That prevents implements 70, 72, 74, 76, etc. from sliding out of their storage spaces when the case is tilted from the horizontal. Case 62 is then rolled up starting at first shorter edge 104 in jelly roll-fashion. When the rolling procedure is finished, shorter edge 106 remains on the outside as shown in FIG. 3. Strap 92 is then again pulled tight to help secure the implements in their respective storage spaces and the strap is wound tightly around the rolled-up case. Mating VELCRO fastening strips 102 on strap 92 prevent strap 92 from loosening and unrolling, thereby keeping case 62 in closed configuration and the implements in place.

Other features of the case are as follows. The case has rounded corners 118, which are less likely to flare out than square corners would be when the case is rolled up. Major axes 116 (only one of which is shown) of ribs 84 lie substantially perpendicular to the direction in which the case is rolled to close it. Because case 62 is made of a water- and oil-resistant material, the case may be used in the field. As seen in FIG. 2, when the case is completely open, it can lie flat to form a large, clean work surface upon which to perform the gun disassembly and cleaning procedure.

Figure 4:
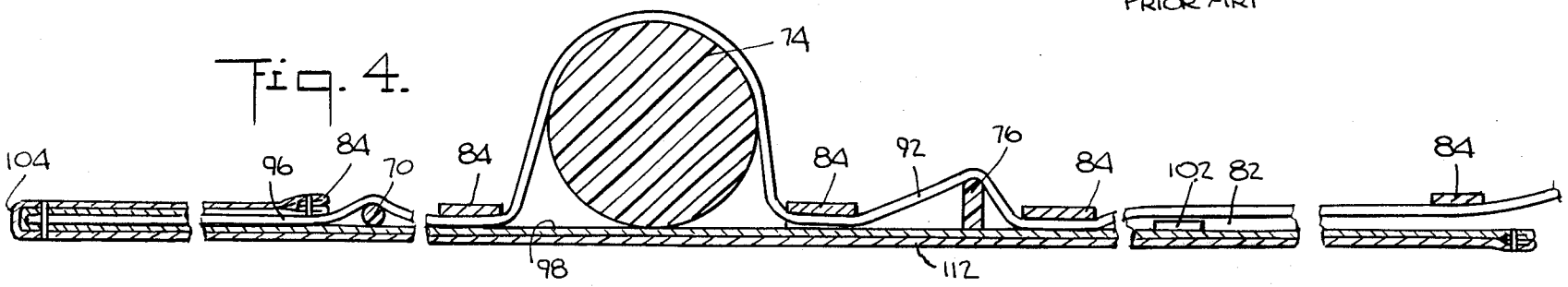
FIG. 4 is a cross-sectional view of the kit taken along line 4—4 of FIG. 2.

FIG. 4 is a cross-sectional view taken along line 4—4 of FIG. 2. In FIG. 4 the great difference in cross-sectional size between screwdriver shaft 70 and container 74 can be seen. Because strap 92 can be pulled tight through gateways 88, all the implements, regardless of their cross-sectional size or shape, are held firmly in their respective storage spaces. As seen in FIGS. 2 and 4, storage spaces are formed by adjacent gateway means (ribs 84) and by the inner surface 98 and the portion of strap 92 between those adjacent gateway means. It is a feature of this invention that the belt is flexible and strong enough so that it can be pulled tight to accommodate implements that vary greatly in size and shape.

Variations and modifications will be apparent to those skilled in the art and the claims are intended to cover all modifications and variations that fall within the true spirit and scope of the invention. For example, the sequence of the implements in the case is generally unimportant. The gateway means (ribs) may be of almost any length, width, or thickness, so long as the required gateways are formed and they are sufficiently wider than the strap. The gateways generally should be in a straight line and should be big enough so that strap 92 can be pulled with a minimum of effort to secure all of the implements tightly in their storage spaces.

It may be desirable in certain instances to use more than one strap. There would then be two sets of gateways, one for each strap. Other fastening means such as snaps or buttons may be substituted for one or more pairs of the VELCRO fasteners. One or more extra storage spaces may be provided for hunting knives and the like (see FIG. 2, empty storage spaces between the first and second and second and third ribs from the right of the drawing).

The case may be made of any material provided it has the required strength, flexibility, resilience, and durability. Generally oil- and water-resistant materials such as plastics are preferred. Burlap may also be used. The case may have any number of storage spaces, but for the universal gun disassembly and cleaning kit of this invention, the implements shown are generally all that are required. Instead of having elastic strap 100 to hold the small implements, the left portions of flaps 120 and 122 (FIG. 2) could be sewn to inner surface 98 to form similar pockets for holding the small implements. In that case, flaps 120 and 122 would not lift up along substantially their entire length as shown in FIG. 2, but would lift up only to the right (as viewed in FIG. 2) of the small pockets formed to hold the small implements.

I claim:

1. A portable gun disassembly and cleaning kit that may be used to disassemble and clean essentially all types and sizes of guns and that may be used in the field, said kit comprising:

(a) implements for disassembling and cleaning essentially all types and sizes of guns, the implements being securely held in their storage spaces in the carrying case of element (b); and (b) a flexible, foldable, oil-resistant and water-resistant carrying case, said case being capable of being rolled up in jelly roll-fashion into its closed configuration and unrolled into a substantially flat open configuration; the case having two oppositely disposed longer edges, two oppositely disposed first and second shorter edges, an inner surface, an outer surface that is outwardly disposed when the case is closed, and elastic strap means attached to the inner surface for releasably holding small implements; rolling to close the case starting with the first shorter edge so that when the case is in its closed configuration the second shorter edge is exposed; the inner surface carrying gateways means that are attached to it and are spaced from one another on the inner surface, each such means having a portion that is not attached to the inner surface of the case so as to define a gateway, the gateways lying substantially in a line roughly parallel to the direction in which the case is rolled to close it; an elongate strap passing through the gateways and having two ends, the elongate strap being fixed to the case near one end of the strap and extending beyond the second shorter edge of the case; two adjacent gateways means, the inner surface of the case therebetween, and the portion of the elongate strap therebetween defining a storage space for one or more of the implements; all of the gateways being large enough in comparison to the cross-section of the elongate strap so that the strap can be easily pulled through all of the gateways to securely hold all of the implements in their storage spaces when the case is closed.

2. The kit of claim 1 wherein the gateway means are ribs whose major axes are substantially perpendicular to the direction in which the case is rolled to close it.

3. The kit of claim 1 wherein each longer edge of the case meets the second shorter edge of the case to define a corner and the corner is rounded, thereby decreasing the tendency of the corners to flare out when the case is closed.

4. The kit of claim 1 wherein the case further comprises two side flaps disposed along and foldably attached to the longer edges, one flap per longer edge, each flap folding inward towards the opposing longer edge so as to prevent any of the implements from sliding out of the case when the case is closed.

5. The kit of claim 1 wherein the case has a flexible sheet attached to the inner surface to form a pocket for holding flat implements.

6. The kit of claim 1 wherein the portion of the strap extending beyond the second shorter edge of the case is wrapped around the rolled-up closed case to keep it from unrolling.

7. A portable gun disassembly and cleaning kit that may be used to disassemble and clean essentially all types and sizes of guns and that may be used in the field, said kit comprising:

(a) implements for disassembling and cleaning essentially all types and sizes of guns, the implements being securely held in their storage spaces in the carrying case of element (b); and (b) a flexible, foldable, oil-resistant and water-resistant carrying case, said case being capable of being rolled up in jelly roll-fashion into its closed configuration and unrolled into a substantially flat open configuration; the case having two oppositely disposed longer edges, two oppositely disposed first and second shorter edges, an inner surface, an outer surface that is outwardly disposed when the case is closed, and elastic strap means attached to the inner surface for releasably holding small implements; rolling to close the case starting with the first shorter edge so that when the case is in its closed configuration the second shorter edge is exposed; the inner surface carrying ribs attached to it whose major axes are substantially perpendicular to the direction in which the case is rolled to close it and spaced from one another on the inner surface, each rib having a portion that is not attached to the inner surface of the case so as to define a gateway between that unattached portion of the rib and the inner surface, the gateways lying substantially in a line roughly parallel to the direction in which the case is rolled to close it; an elongate strap passing through the gateways and having two ends, the elongate strap being fixed to the case near one end of the strap and extending beyond the second shorter edge of the case; two adjacent ribs, the inner surface of the case therebetween, and the portion of the elongate strap therebetween defining a storage space for one or more of the implements; all of the gateways being large enough in comparison to the cross-section of the elongate strap so that the strap can be easily pulled through all of the gateways to securely hold all of the implements in their storage spaces when the case is closed; each longer edge having foldably attached to it a side flap that can be folded inward towards the opposing longer edge so as to prevent any of the implements from sliding out of the case when the case is closed.

8. The kit of claim 7 wherein each longer edge of the case meets the second shorter edge of the case to define a corner and the corner is rounded, thereby decreasing the tendency of the corners to flare out when the case is closed.

9. The kit of claim 7 wherein the case has a flexible sheet attached to the inner surface to form a pocket for holding flat implements.

10. The kit of claim 7 wherein the portion of the strap extending beyond the second shorter edge of the case is wrapped around the rolled-up closed case to keep it from unrolling.

* * * * *